United States Patent [19]

Araki et al.

[11] 4,093,425

[45] June 6, 1978

[54] PROCESS FOR PREPARING COAL BRIQUETTES FOR COKE AND APPARATUS FOR THE PROCESS

[75] Inventors: Eimi Araki, Kyoto; Takeo Sakai; Seizaburo Takai, both of Tokyo; Sekiro Komori, Fukuyama, all of Japan

[73] Assignee: Keihan Rentan Kogyo Co., Ltd., Japan

[21] Appl. No.: 737,021

[22] Filed: Oct. 29, 1976

[30] Foreign Application Priority Data

Nov. 1, 1975 Japan ..... 50-131678

[51] Int. Cl.[2] ..... C10L 5/00; C10L 5/22; B30B 11/00

[52] U.S. Cl. ..... 44/10 F; 44/2; 44/12; 241/189 R

[58] Field of Search ..... 44/10 R, 10 F, 23, 11–13, 44/2; 241/189 R, 46.11, 46.17

[56] References Cited

U.S. PATENT DOCUMENTS

| | | | |
|---|---|---|---|
| 2,370,060 | 2/1945 | Mead | 44/23 |
| 3,457,047 | 7/1969 | Tokimatsu et al. | 241/46.17 X |
| 3,655,350 | 4/1972 | Utley | 44/10 R |

FOREIGN PATENT DOCUMENTS

| | | | |
|---|---|---|---|
| 9,199 of | 1891 | United Kingdom | 44/10 F |

*Primary Examiner*—Carl F. Dees
*Attorney, Agent, or Firm*—Bucknam and Archer

[57] ABSTRACT

The present invention relates to a process for preparing coal briquettes which comprises pulverizing a starting coal mixture, incorporating therein a caking agent, kneading the resulting mixture and molding it and more particularly to a process for preparing coal briquettes which comprises pulverizing said starting coal to the desired degree, incorporating said caking agent in the starting coal mixture at an appropriate temperature in the presence of an appropriate water content, thereby uniformly coating the surface of the starting coal mixture with the caking agent under precise control to obtain an excellent molding material, and then briquetting the latter, as well as to an apparatus for carrying out the process.

13 Claims, 3 Drawing Figures

PROCESS FOR PREPARING COAL BRIQUETTES FOR COKE AND APPARATUS FOR THE PROCESS

BACKGROUND OF THE INVENTION

In the iron- and steel-making industry the blast furnace work has recently come to face serious difficulties as the result of the exhaustion of coal resources which, in turn, has caused deterioration of coal quality, a great rise in the price of high quality coals and difficulties in obtaining such coals. Thus, the production of coke by means of compounding coals has been adopted as a supplementary measure for improving the quality of coals used in the production of blast furnace cokes in order to overcome the insufficiency in strongly caking coal. In this case, however, it is necessary to improve the apparatus for the production of coal briquettes, namely, to improve the performances of the briquetting machine.

In a briquetting machine, a weakly caking coal or a noncaking coal is used either in place of or together with the aforesaid strongly caking coal or caking coal. A weakly caking or noncaking coal is finely pulverized with or without strongly caking or caking coal to such degree that at least 90% thereof is of a particle size of 3 mm of finer, the pulverized coal is kneaded together with a caking agent and cooled, and then the kneading mixture is briquetted into an ellipsoidal shape having a longer diameter of about 30 - 100 mm and a shorter diameter of about 20 - 30 mm or other shape in accordance with the purpose of use, to obtain a coke having high quality and high strength from a weakly caking or noncaking coal. Ordinarily, good results can be obtained by blending 3 to 4 kinds or at most 7 to 8 kinds of starting coals, in the same manner as in the usual caking processes of caking or strongly caking coals. The coal briquette thus obtained is used for the production of cokes, either alone or after having incorporated therein one third, based on the total weight, of a caking or strongly caking coal. Accordingly, the composition ratio of the starting coal mixture is so selected, according to the empirical rule and the results of preliminary experiments, that the volatile matter content, dilatation degree, and the fluidity, etc. fall into the desirable ranges. The balance between various properties such as ash content, sulfur content and the like, should also be taken into consideration.

Said caking agent is employed for the purpose of giving the weakly caking coal not only an adhesive character but also the caking power necessary for forming a coal briquette. There have hitherto been disclosed many types of caking agents, most of which have been obtained through a treatment of tars or pitches. They are roughly classified into petroleum type and coal type. A few examples of caking agents commercially available are shown below:

Petroleum type: P. D. A. (propane-deasphalted asphalt), S. D. A. (solvent-deasphalted asphalt), S.A. (straight asphalt), K. R. P. (Kreba Reginus pitch), A. S. P. (asphalt pitch) and natural asphalt;

Coal type: pitch (high, medium, low), tar, creosote oil, anthracene oil.

In addition to the above, it is also effective to use a petroleum type binder in combination with a coal type one in a certain definite proportion.

A variety of caking agents are used depending on the nature and combination of the starting coals used. The quantity of caking agent is usually in the range of 6 to 10% by weight based on the total coal.

Some of the caking agents are liquids, but the others are solids which melt at the kneading temperature. A caking agent is added to a finely pulverized compounded coal and kneaded with them so that the caking agent spreads over the pulverized coal well, coats the surface of said coal and adheres to the coal. This can be realized only in the presence of a certain quantity of water in the kneaded mixture. In other words, a petroleum type or coal type of caking agent can spread satisfactorily on the surface of finely devided coal only in the presence of water. A satisfactory results can be obtained by effecting the kneading in the presence of about 8 to 14% by weight of water, including the water originally contained in the starting coal. An excessive quantity of water is undesirable because it condenses and remains in the coal briquette. In the conventional processes, the water is fed by direct blowing of steam into the kneader which steam heats the kneader at the same time. The kneader rotates as low as 17 to 20 r.p.m. and this means the use of an excessive steam.

In general, starting coals contain about 8 to 14% water, because they have been stored outdoors. However, the product, raw coal for coal briquette preferably contains about 5 to 8% of water. Therefore, it is necessary to release the excessive water in the course of kneading and leave a desirable water content behind in the coal. Nevertheless, the excessive water tends to form condensed water in the conventional processes, particularly in the wet processes. Thus, the aforesaid desirable water content is difficult to realize so far as the conventional processes are concerned.

DESCRIPTION OF THE PRIOR ART

The process for preparing coal briquette presently adopted comprises the steps of weighing and mixing the starting coals, throwing the mixed coal into a tank, pulverizing the mixed coal by means of a pulverizing device, incorporating a caking agent into the mixed coal, kneading the resulting mixture, and charging it into a briquetting machine and briquetting it.

According to the conventional method, however, each of the above-mentioned steps is carried out separately from other steps in an independent apparatus, so that each apparatus requires auxiliary devices (for example, a transportation unit such as conveyor) and the process is complicated and requires much labor. In addition, it is difficult to obtain products having consistent quality.

The proper water content of a raw coal for briquetting is in the range of about 5 to about 8% by weight as mentioned above. The most appropriate water content is determined to match to the respective conditions such as the kind and size distribution of the starting coal, and the kind, characteristics and amount used of caking agent, etc. However, because in the conventional method, heating of the kneader is conducted by direct blowing of steam, the excess water in the coal cannot be fully released, and thus the proper water content cannot be attained.

If the water content of the raw coal for briquetting is below about 5%, there is obtained a coal having inferior or bad briquette moldability which, if briquettes moldable at all, results in a coal briquette having very low crushing resistance. If the water content of the raw coal for briquetting is over about 8%, the said coal has good briquette-moldability, but the coal briquette obtained has bad crushing resistance and light specific gravity and is not good for coking.

Regarding prior art, a further explanation will be given in the following paragraphs.

According to the prior art, starting coal is pulverized with a pulverizer such as a disintegrator, ball mill, hammer mill, impeller breaker, etc. Since coals are stored in the outside yards and exposed to rain and sunshine and thus contains various quantities of water, there can occur a number of troubles such as fluctuation in size distribution, variation in the quantity of contained water, variation in the quantity of coal treated, and thus there arise difficulties in mechanical operation (e.g., clogging, adhesion of coal particles to various parts of the machine, etc.). Among these troubles, the fluctuation in water content can be covered to some extent by the release of water in the course of the operation, but this will cause fluctuation in quality. Moreover, the variation in size distribution affects the properties of the coal briquette thus obtained. In some types of machines, a huge "dust and mist collector" must be provided in order to cope with dust. If one wishes to avoid this trouble, a special drying device such as rotary kiln must be provided in order to normalize the water content of the coal to be charged into the machine and improve the adhesive effect of the caking agent. These are both undesirable in view of environmental pollution and energy economy.

Thus the pulverized coal so obtained is then sent to the mixing step where it is mixed with caking agent. A variety of mixing devices can be utilized in this step. In case the added caking agent is a solid powder at ambient temperature, it can merely mechanically be mixed with the starting coal, because the temperature of the starting coal is also at around ambient temperature. In case the caking agent is supplied in the form of a liquid at elevated temperature, it can only adhere to and solidify on the surface of coal and cannot spread over the whole surface of the coal particles. At any rate, the caking agent cannot be uniformly spread and is merely mixed with the coal as a bulk.

In the next step, the resulting mixture is charged into a kneader. In this apparatus, steam is directly introduced into the mixture with stirring and kneading by which the mixture is heated and the caking agent is spread over the surface of the coal particles in the presence of water.

There are three types in the kneading: the vertical type, horizontal type and inclined type. Steam is directly blown into any of these types. Since the kneader has an shaft equipped with many agitating blades to knead the coal therein, it encounters increasing mechanical resistance as the caking agent dissolves, and the rotating speed of the shaft is usually about 20 r.p.m. and at most 40 to 50 r.p.m. With such rotating speed, it is impossible to spread the caking agent into the form of a thin film uniformly covering the coal surface. In other words, it is impossible at the present stage to obtain a sufficiently kneaded mixture satisfactorily usable in the production of coal briquette. In briquetting the starting coal, the caking agent should be mixed with, melted and spread onto the starting coal as sufficiently as possible. If the caking agent has a melting point of 100° C or higher, however, it cannot be melted by the prior art method, because the temperature of the starting coal cannot exceed 100° C because of the existence of water in the coal, unless its water content is reduced to zero which cannot be achieved by the introduction of steam. This is a fatal disadvantage of the prior art method.

In this type of kneader, steam is partially discharged from the top of the apparatus. This is for the reason that if the total heat of the steam is utilized, there occurs a partial condensation of steam to yield liquid water which constitutes excess water undesirable in the briquetting process. As a result, the heat efficiency of the kneader is so low as 30 to 40% which is undesirable from the viewpoint of energy economy. In addition, at the time of discharging steam from the kneader, the kneader blows out fine particles of coal together with the steam and thus a huge "dust and mist collector" is required for recovery of discharged coal. This constitutes another disadvantage of the prior art method.

The kneaded coal thus obtained is then sent to a series of independent apparatuses including a cooling apparatus, a heating apparatus, an apparatus for adding water and so on, in which the water content and temperature of the coal is regulated to the values suitable for the briquetting process. Conditions other than water content and temperature cannot be controlled so far as the prior art technique is adopted.

The description presented above is concerned with the general process according to the prior art. In the manufacture of coal briquettes of conventional type, there has been adopted the wet process and the dry process. However, they are no more than a slight modification of the above-mentioned general process. The wet process herein referred to is a process in which a starting coal is molded with a briquetting machine without removing the attached or included water in the state as it is (containing 8 - 14% water). The dry process referred to herein is a process in which the water content of the starting coal is reduced to 5 - 6% by means of, for example, a dryer and water addition to the coal is prevented as much as possible in the course of kneading by adopting an indirect heating method.

SUMMARY OF THE INVENTION

Accordingly, an object of the present invention is to provide a process for obtaining a strong coal briquette with ease from various kinds of coals and thereby overcoming the difficulties in the above mentioned prior art method and to provide an apparatus therefor.

Further object of the present invention is to provide a process for obtaining a raw coal for coal briquette which comprises pulverizing a starting coal, incorporating therein a caking agent and kneading the mixture at appropriately adjusted granular size, water content and temperature, and to provide an apparatus therefor.

Another object of the present invention is to provide a process in which a small quantity of caking agent can be spread uniformly on the surface of coal particles so as to form a uniform thin film thereon, and to provide an apparatus therefor.

Still another object of the present invention is to provide a process for obtaining a raw coal for coal briquette by which an excellent caking effect can be given to coal by the use of various caking agents, and to provide an apparatus therefor.

Still another object of the present invention is to provide an apparatus for obtaining a raw coal for coal briquette in which the pulverization of mixed coal, addition of caking agent to the pulverized coal and kneading of the resulting mixture can be carried out by means of a single machine and thereby the above-mentioned object of the invention can fully be achieved.

A still further object of the present invention is to provide an apparatus according to the preceding paragraph wherein the friction heat occurring in the course of pulverization and kneading of the starting coal can effectively be utilized for the operation of the apparatus.

Another still further object of the present invention is to provide an apparatus which is free from environmental pollution such as occurrence of dust and mist and can be operated by a continuous process with a high degree of automation.

Other objects of the invention of this application will become apparent from the following descriptions, accompanying drawings and appended claims.

DESCRIPTION OF THE PREFERRED EMBODIMENTS

Figure 1:
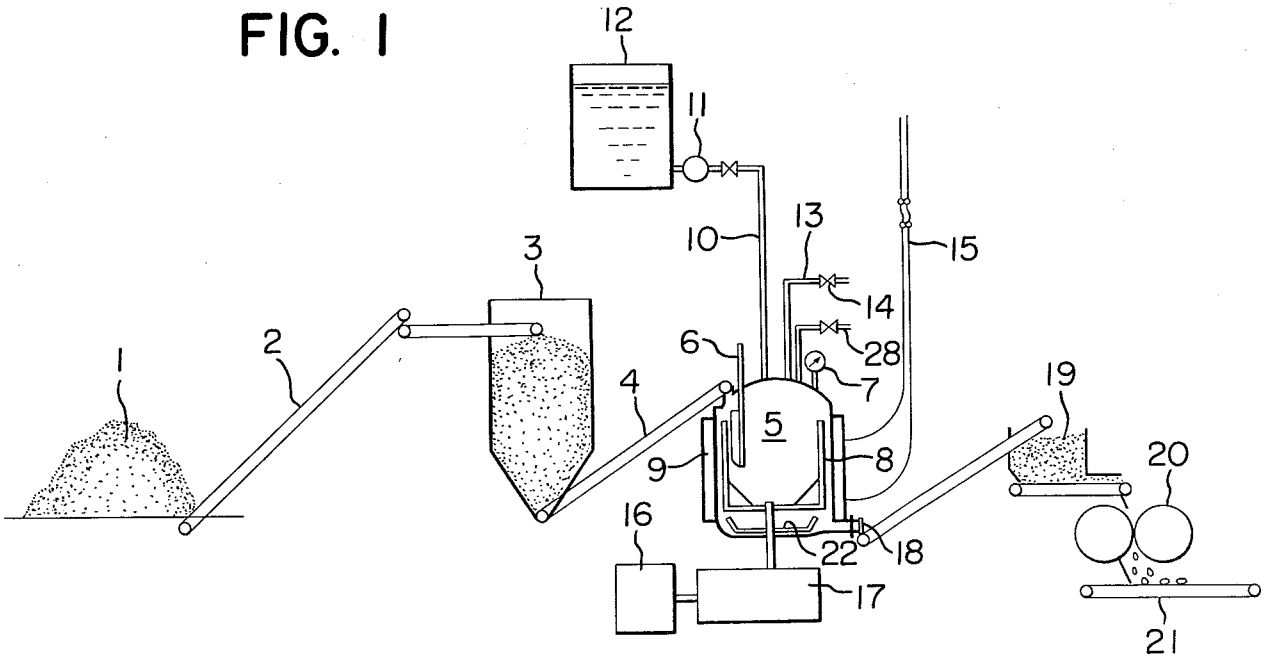
FIG. 1 is a flow diagram of the apparatus of the present invention in which the steps for transporting a coal from the outdoor yard and fabricating it into a coal briquette are illustrated.
Figure 2:
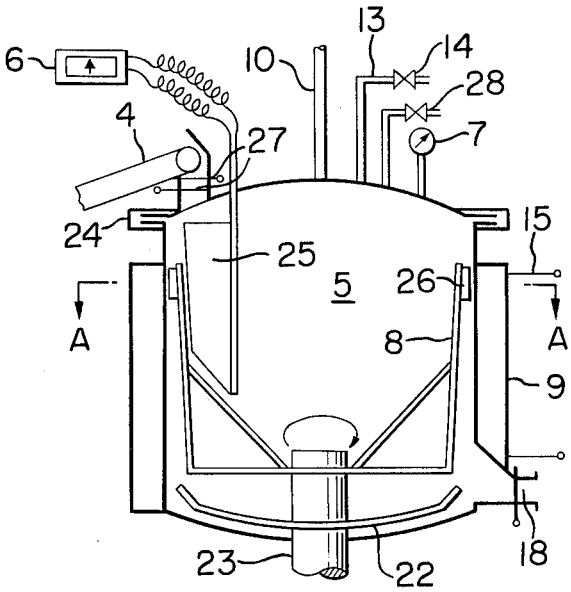
FIG. 2 shows a longitudinal cross sectional view of the pulverization-kneading apparatus used in the present invention shown in FIG. 1.
Figure 3:
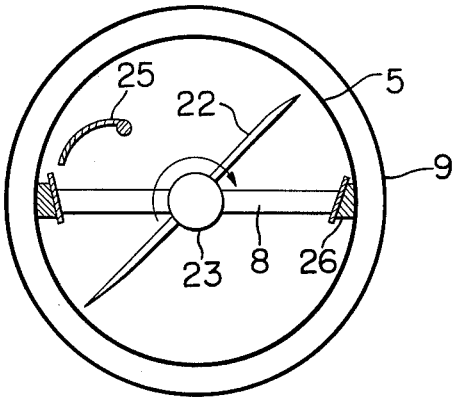
FIG. 3 shows a cross sectional view taken along line A—A in FIG. 2.

The important conditions necessary for briquetting include the followings: that the granular size should be controlled in accordance with the characteristics of the kneaded coal, that the mixture of a coal and a caking agent should be sufficiently kneaded at an appropriate temperature selected in accordance with the characteristics of the caking agent to spread the caking agent onto the whole surface of coal particles, and that the water content of the mixture should be adjusted to an appropriate value in order to obtain good spreading of the caking agent onto the coal particles.

The present invention has been accomplished as a result of extensively conducted studies to over-come the disadvantages of the prior arts mentioned above. Thus, the present invention provides a process, and an apparatus for said process, by which can be produced raw coal for a coal briquette for use in the manufacture of cokes by the use of a caking agent which comprises pulverizing a starting coal while the water contained in the latter is left as it is, adjusting the granular size to an appropriate value suitable for the briquetting process, effectively utilizing the friction heat occurring at the time of pulverization for maintaining the system temperature at the softening temperature (fluid point) of the caking agent which constitutes one of the characteristic properties of the present invention, if necessary, supplying external heat to regulate the system temperature, thereby facilitating the contact between the particles of starting coal and the caking agent, and regulating the system water content to an appropriate value for briquetting by controlling the internal pressure of the vapor occurring in the process so as to increase or decrease the water content of the starting mixture, all the above-mentioned steps being carried out in a single apparatus. The caking agents usable in the invention include petroleum type caking agents, coal type caking agents, and many other types of caking agents.

According to the present invention, the pulverization of starting coal, the addition of caking agent and the kneading can be carried out in a single apparatus. The operation can be completed in a short period of time, for example in 3 to 10 minutes, preferably in 4 to 6 minutes so that the obtained raw coal for briquetting can be charged into the briquetting machine under the best conditions.

The characteristic features of the present invention are as follows: charging a starting coal into a treating tank equipped with two types of stirring devices, one being a conventional type and the other being a rotating blade which is provided at the bottom of the tank, and can be driven independently of the said conventional stirring device and pulverizing the charged coal therein under a high speed rotation of 500 – 1000 r.p.m., maintaining both the inlet and the outlet closed at this time so that the temperature of the starting material itself rises due to friction as its pulverization progresses. There occurs in general a temperature rise of about 30° to 100° C depending on the characteristics of the charged starting coal, its size and its water content. However the temperature rise is determined by taking into consideration of the melting point of the caking agent used, and if necessary, heat is added to the system indirectly from the outside by means of steam, heat transfer medium oil or electrical heating until the temperature of the starting coal reaches the necessary value, and transforming the water present in the coal into vapor to increase the inner pressure of the closed vessel, and if the temperature of starting coal exceed 100° C as the result, the temperature of the coal itself also rises beyond 100° C.

Since the treating tank is closed, all the dust and mist stays in the tank. When the size of the coal particles reaches the intended value and the temperature reaches the predetermined value, a caking agent is supplied from the top of the tank in the form of a liquid jet when it is a liquid or in the form of fine particles when it is a solid. At this time, the speed of the stirrer is decreased in accordance with the characteristics of the caking agent (400 – 800 r.p.m.). Excess water and generated gases are discharged through a control valve provided at the top of the apparatus into te exterior atmosphere. If the water content of the starting coal is insufficient as is often the case in summer, a supplementary quantity of water conducted fed through another inlet provided at the top of the apparatus. Maintenance of pressure is closely related to the water content of the starting coal and the characteristic melting point of the caking agent. If the pressure is insufficient, external steam is fed so as to maintain the necessary pressure and appropriate water content. During the above-mentioned operation, the speed of rotation is maintained at a given value. After a predetermined period of time (3 to 10 minutes) has elasped, the treated material is discharged through an outlet provided at the bottom of the apparatus and sent to a molding machine.

In the above-mentioned operation, the stirrer rotates at a high speed during the step of pulverization, but at a lower speed during the step of kneading, so as to accomplish the intended object of the invention. Because the kneading is carried out at a high temperature with strong stirring, and because it is carried out in the presence of an appropriate quantity of water, it is extremely effective.

In the process of the present invention, the granular size is adjusted to the optimum value by controlling the speed of the stirrer and the operation period in conformity with the nature of the mixed coal used. On the other hand, the kneading is carried out under optimum conditions, namely the pulverized coal is kneaded with caking agent under optimum temperature with addition or removal of water to maintain the best condition, in consideration of the size of the starting coal, its water content, the nature of the caking agent, etc. It is preferable, therefore, to determine the optimum conditions through a preliminary experiment with the same mixed coal and caking agent.

According to the invention, the starting coal is pulverized and the temperature thereof is kept at a desirable value and therefore, the added caking agent can be blended thoroughly with the coal particles, melted sufficiently over spread ver the particles and, at the same time, the water content of the system can be controlled more precisely than in any of the conventional processes. Water content of the coal briquette is preferably in the range of about 5 to about 8% as mentioned above, although it depends somewhat on the nature of the starting coal, the nature of the caking agent, the granular size of the coal, etc. In general, however, starting coal contains as much as 8 to 14% of water. Therefore, water is partially removed in the kneader at an elevated temperature so that the water content reaches a reasonable value. Since the process and apparatus of the present invention make it possible to regulate the water content precisely as mentioned above, it is always possible to obtain a starting coal of desirable water content. In the summer when the water content of coal is apt to be insufficient, it is possible to add water to the coal so as to keep the molded coal to a reasonable water content.

As has been mentioned above, the process of the invention is also advantageous in respect of energy economy in that it consumes only one half as much motive power (5 to 6 KWH per ton of molded coal) and one third as much heat energy (20,000 - 25,000 Kcal per ton of molded coal) as the conventional processes. It is also advantageous in view of the prevention of environmental pollution in that all conveyance of all materials is by gas stream so that no occurrence of dust and mist is observed in any of the operation units. This makes it possible to prevent environmental pollution without using any special expensive devices. Moreover, the apparatus of the invention occupies as little as one half the ground area of the conventional apparatuses, because its operation units do not necessitate many independent units.

The present invention will be further illustrated below with reference to the accompanying drawings. Starting coal 1 stored outdoors is sent into hopper 3 of pneumatic carrier placed indoors by means of belt conveyer 2. The starting coal is automatically and intermittently sent through pneumatic carrier 4 into treating tank 5. The end of the pneumatic carrier is so designed that it is tightly closed after the coal has been delivered. The treating tank 5 is equipped with thermometer 6 which measures the inner temperature. U type rotating blade 8 and rotating blade 22, fixed co-axially or to the same shaft, are rotated at a high speed by motive power source 16 through speed controller 17.

The starting coal in the tank is pulverized by the blade rotating at a high speed and a rise in temperature is caused by frictional heat. When the temperature indicated by the thermometer 6 does not reach the intended value, the starting coal is heated by the aid of a heat source placed in the external heating cabinet 9. The heat source may be of electrical heating type, superheated steam type, or the like. Upon external heating, the inner pressure rises. If the water content of the system is lower than the value expected from the system temperature, water is forced into the tank through water charge tube 28. When the inner temperature and the water content have just reached the intended value by the aid of external heating, a signal is produced to slow the speed of the regulator. At the same time, a caking agent stored in tank 12 is sent and ejected into tank 5 through pump 11 and pipe 10. The caking agent is mixed with starting coal by stirring and melts and spreads on the coal particles at a high temperature. Concurrently, the water contained in the starting coal vaporizes so that the inner pressure of the closed tank ascends. The pressure is measured with a pressure guage. When the pressure exceeds the intended value, steam is discharged through duct 13 and pressure control valve 14 into the external atmosphere.

After these steps have been completed, outlet 18 is opened and the material is sent into hopper 19 placed on the briquetting machine 20 and then into the briquetting machine 20 itself. The briquetted product is transported outside of the apparatus by conveyer 21. The step mentioned above take only 3 to 6 minutes, preferably 4 to 6 minutes in total.

Although the mixing of coal and caking agent are performed in batch operation, it can also be carried out continuously by using two tanks alternately. It is also possible to place two or three treating tanks 5 in parallel from which the treated material is discharged alternately into hopper 19 and briquetted continuously if the capacity of the briquetting machine so permits.

When the treated material thus obtained according to the process of the present invention is used, the coal briquette obtained has a higher density, a higher true specific gravity and a much lower water content than coals briquetted according to the conventional processes. Thus, an excellent starting material for the manufacture of cokes is obtained.

The treating tank of the invention which constitutes the characteristic feature of the invention will be illustrated below in further detail.

The U type rotating blade 8 keeps an angle of 5° to 30° with respect to the direction of rotation, and its cutting part has a taper for the convenience of the cutting work. The upper part of the rotating blade 8 is equipped with a protecting blade 26 which protects the upper wall of the tank against the adhesion of material. The lower rotating blade 22 is in the shape of a propeller and resides at the bottom of the tank 5.

Pressure-reserving device 23 is resistant to high speed rotation and is closely contacted with the shaft so as to maintain the inner pressure. Another pressure-reserving device 24 is provided for the purpose of maintaining the inner pressure of the tank throughout the operation and is so designed that it can be opened when the tank requires repair or the blade is changed.

In treating tank 5 coal collection blade 25 is provided on a shaft and has a sectoral cross section facing the direction of rotation of coal. The angle of the blade is changeable from outside. Adhesion-preventing blade 26 prevents the apparatus wall from the adhesion of coal dust. Double door 27 provided at the inlet for starting coal is a two-step, alternate-opening type of tight door which is used for the prevention of dust and mist as well as for the preservation of inner pressure.

When starting coal is sent through pneumatic carrier 4 into treating tank 5 as has been mentioned above, the upper and lower doors of the door 27 are opened and closed alternately to allow a necessary quantity of coal to be rapidly supplied to the tank. After the coal has been supplied, the door is kept closed in order to prevent the scattering of dust, the leakage of steam and the loss of heat.

Rotating blade 8 and 22 are fixed coaxially or fixed on the same shaft and can rotate with high speed. Having the shape of a propeller, the lower rotating blade makes the starting coal rise to the upper part of the tank. The floating coal is pulverized by the upper rotating blade 8. The latter has an angle of 5° to 30° to the direction of rotation so that it has a great contact area with the starting coal, which enhances the effect of pulverization and elevates the temperature of the coal itself owing to the friction. The shaft rotates at so high a speed as to expel the coal toward the wall of the tank due to centrifugal force. The collecting blade 25 is for the purpose of changing the fluid current and driving the coal toward the central position. The angle of the collecting blade can be altered from outside.

The adhesion of coal to the upper circumference of the tank is promoted by the presence of excessive water in the starting coal particularly at the beginning stage of the treatment (in the first one or two minutes). The adhesion-preventing blade 26 provided for the purpose of scraping off adhering coal is placed over the blade 8 and makes a scraping angle of 10°–30°.

The angles of collecting blade 25 and preventing blade 26 constitutes a particularly important factor. In the apparatus of the invention which is operated at high speed, the blade exert good effects upon pulverization and elevation of temperature. The subsequent operations and functions have already been mentioned above.

The following examples will further illustrate the invention of this application, where the examples are limited to those cases where a starting material for coal briquette is prepared without adding any external water. Addition of external water belongs to a special modification adopted during summer. One skilled in the art will easily understand the operations and the results in the case of adding water with reference to the description given below.

EXAMPLE 1

In this example, the dependencies of granular size, temperature elevation and water content upon the mode of pulverization were examined. A mixed coal composed of 70% Taiheiyo coal and 30% BK coal (hereinafter referred to as Coal A) was pulverized either with the conventional disintegrator or by the process of the present invention. The results obtained were as shown in Table 1. The apparatus of the present invention used for the pulverization has the following dimensions:

Lower stirring blade: 1000 mm in length, 50 mm in width and 5 mm in thickness;

Upper stirring blade: 250 mm in height of U shape, 130 mm in horizontal length of U shape, 5 mm in thickness, 50 mm in width;

Quantity of coal treated per run per tank; 10 liter coal/one run;

Duration of treatment: 4 minutes;

Mode of heating; indirect heating.

Table 1

| Granular size | Pulverization of Coal A (Japanese coal) | | | | |
|---|---|---|---|---|---|
| | Starting coal | Disintegrator | The process of the invention | | |
| | | | 400 r.p.m. | 600 r.p.m. | 1000 r.p.m. |
| 3 mm above | 50.4% | 24.5% | 14.6% | 8.1% | 0 % |
| 3 - 2 mm | 13.3% | 16.1% | 10.5% | 5.9% | 7.1 % |
| 2 - 1 mm | 12.1% | 14.5% | 12.4% | 11.8% | 9.8 % |
| 1 mm under | 24.2% | 44.9% | 62.5% | 74.2% | 83.1 % |
| Water content before pulverization | 9.8% | 9.8% | 9.8% | 9.8% | 9.8% |
| Water content after pulverization | — | 9.2% | 8.0% | 7.3% | 6.8% |
| Rise of temperature | — | +2° C | +51° C | +72° C | +85° C |

In another experiment, a mixed coal for manufacture of metallurgical cokes which has comprised of British, Australian, Russian and Japanese coals (hereinafter referred to as Coal B) was pulverized with the same apparatus under the same conditions as the above. The results obtained were as shown in Table 2.

Table 2

| Granular size | Pulverization of Coal B (mixed coal of foreign coals and Japanese coal) | | | | |
|---|---|---|---|---|---|
| | Starting coal | Disintegrator | The process of the invention | | |
| | | | 400 r.p.m. | 600 r.p.m. | 1000 r.p.m. |
| 3 mm above | 19.0% | 12.5% | 6.9% | 3.0% | 0 % |
| 3 - 2 mm | 11.9% | 11.4% | 8.8% | 7.0% | 2.4% |
| 2 - 1 mm | 17.8% | 17.9% | 12.4% | 12.7% | 8.7% |
| 1 mm under | 51.3% | 58.2% | 71.9% | 76.6% | 88.6% |
| Water content before pulverization | 7.8% | 7.8% | 7.8% | 7.8% | 7.8% |
| Water content after pulverization | — | 7.5 | 6.0% | 5.5% | 5.9% |
| Rise of temperature | — | +1.5° C | +55° C | +79° C | +95° C |

According to the process of the present invention, as seen in Tables 1 and 2, the granular size decreases with the rise in rotating speed, the water content decreases after the pulverization, and the temperature rises owing to frictional heat. Since the rotating speed of the rotating blade can be controlled smoothly in the range of 0 to 1500 r.p.m., the granular size can be adjusted to an arbitrarily chosen value.

EXAMPLE 2

Coal B was pulverized with the same apparatus as used in Example 1 at a rotating speed of 800 r.p.m. Immediately after completion of the pulverization, a petroleum type caking agent (propane-deasphalted asphalt, mp. 50°- 75° C) was added and the resulting mixture was indirectly heatd with external steam of 2 kg/cm$^2$. The rotating speed was elevated to 700 r.p.m. and the excessive water was discharged in the form of steam. After operation for 3 minutes, the starting coal was discharged and briquetted with a briquetting machine.

The products thus obtained were compared with those obtained by the conventional process.

Into the starting coal (Coal B) was incorporated a petroleum type caking agent in a proportion of 6.5%, 7.0% or 7.5%. The results obtained were as summarized in Table 3.

The conditions of the conventional process employed in this example were as follows: 70% strong caking coal; 30% caking coal (containing 15% Japanese coal); Coking Index of the mixed coal 88% or higher; after mixing, the mixture was pulverized to a size of 3 mm under 88%; the mixed coal was further mixed by means of a double screw type mixer (manufactured by Keihan Co., Japan), during which the same quantity of the same caking agent as mentioned above was added.

Table 3

| | Conventional process | | | Process of the invention | | |
|---|---|---|---|---|---|---|
| Proportion of caking agent* | 6.5% | 7.0% | 7.5% | 6.5% | 7.0% | 7.5% |
| Briquetting temperature (° C) | 73 | 73 | 74 | 98 | 103 | 111 |
| Water content of briquetting process (%) | 9.8 | 9.7 | 9.8 | 5.0 | 5.0 | 4.9 |
| Water content in briquetting coal (%) | 9.3 | 9.0 | 9.0 | 4.9 | 4.9 | 4.8 |
| Crushing hardness (kg/P)** | 43 | 54 | 63 | 78 | 83 | 91 |
| Sp.gr. of product | 1.112 | 1.118 | 1.120 | 1.221 | 1.231 | 1.241 |

(Note)
*Caking agent P.D.A.
**Crushing hardness (kg/P) was obtained in accordance with the Testing Standard of Japanese National Railroads, and is represented in terms of pressure resistance per piece of molded coal.

According to the conventional process, as seen in Table 3, the change in the quantity of caking agent causes no great changes in the temperature and water content at the time of briquetting nor in specific gravity of product and only a slight change in crushing hardness (from 43 kg/P at 6.5% addition to 63 kg/P at 7.5% addition).

Therefore by the conventional process granular size seems to be unchanged by the briquetting conditions, and only the increase in the absoluble amount of caking agent affects the crushing behavior. The result obtained by the invention are in great contrast to those of the conventional method in that the crushing strength is higher than in the conventional process by about 30 - 35 kg/P for all percentage of addition (6.5%, 7.01% and 7.5%).

A crushing strength of 55 or more is satisfactory to resist handling. The high crushing strength obtained according to the invention is attributable to the aforementioned precisely controlled granular size of the coal as well as to the higher temperature of the kneading system which permits the caking agent to be sufficiently dissolved, mixed and spread onto the surface of the coal granules. This results in the high specific gravity and high crushing strength of the product.

EXAMPLE 3

A number of experiments were carried out in the same apparatus as in Example 1, using a mixed coal obtained by mixing Taiheiyo coal and KIB coal in various ratios and using as a caking agent, P.D.A. and soft pitch. The results were as shown in Table 4.

Table 4

| Item / Run No. | 1 | 2 | 3 | 4 |
|---|---|---|---|---|
| Test conditions: | | | | |
| 1. Rotation number of mixer (rpm) | 400 | 500 | 600 | 450 |
| 2. Amount of charged material (kg) | 500 | 480 | 450 | 550 |
| 3. Time period of treatment (min) | 4 | 4.5 | 4 | 3.5 |
| 4. Name of used coal | Taiheiyo 70 KIB 30 | ibid | Taiheiyo 50 KIB 50 | Taiheiyo 20 KIB 80 |
| 5. Kind of caking agent | PDA | PDA | PDA | Soft pitch |
| 6. Amount of the same (% by weight) | 6.0 | 6.5 | 7.0 | 7.5 |
| Measured items: | | | | |
| 1. Granular size of charged coal (% under 3 mm) | 80 | 80 | 83 | 85 |
| 2. Granular size of treated coal (% under 3 mm) | 85 | 88 | 91 | 89 |
| 3. Water content of charged coal (%) | 9.7 | 11.0 | 9.0 | 12.0 |
| 4. Water content of Briquetted coal(%) | 5.1 | 5.0 | 4.7 | 5.3 |
| 5. Temperature of briquetting | 34° C | 33° C | 32° C | 34° C |
| 6. Water releasing upon treatment | Observed | Observed | Observed | Observed |

Table 4-continued

| Item | Run No. 1 | 2 | 3 | 4 |
|---|---|---|---|---|
| Physical properties of product | | | | |
| 7. Crushing strength (kg/P) | 75 | 83 | 94 | 97 |
| 8. Trommel strength(%) | 88 | 91 | 93 | 94 |
| 9. Specific gravity | 1,198 | 1,210 | 1,220 | 1,213 |

EXAMPLE 4

The procedure of Example 2 was repeated except that the caking agent was used in an amount of 7.5% and coal B was used as the starting coal. The coal briquette was coked under the same coking conditions using the coal kneaded either according to the process of the present invention or according to the conventional process. Strengths (drum indices) of the resulting cokes were compared as shown in Table 5.

Table 5

| (Starting Coal B, caking agent 7.5%) | | |
|---|---|---|
| Drum index Process | Conventional process | Process of the invention |
| $D_{15}^{30}$ | 92.0 | 93.8 |
| $D_{15}^{150}$ | 78.8 | 82.3 |

The method and conditions used in coking were as follows:

The cokes were prepared by dry distillation with a chamber type coking furnace. Strengths of the resulting cokes were measured according to the procedure of JIS (Japanese Industrial Standard).

The drum indices shown in Table 5 were those of the cokes prepared from starting coal B and 7.5% petroleum type caking agent. The process of the invention is superior to the conventional process in drum index by +1.3% with regard to 30/15 and by +3.5% with regard to 150/15. The differences in drum indices between the two processes are due to the differences in granular size of coal, melting behavior and spreading behavior of caking agent and water content under molding condition. Thus, it is understandable that the process of the invention gives not only better physical properties but also a better coking property to the molded coal.

As is obvious from the description presented above, the process according to the present invention is superior to the conventional processes in view of the characteristic properties and coking property of the coal briquette obtained and in view of energy economy. Moreover, it causes less environmental pollution and requires less installment area in the construction of the factory. Thus, the process of the invention doubtlessly provides an excellent method capable of said application in the molded coal industry hereafter.

What we claim is:

1. A process for preparing a coal briquette by pulverizing a starting coal followed by adding a caking agent and then molding the resulting mixture, which comprises introducing coal into a tightly closed vessel equipped with a high speed rotating blade, pulverizing the coal, while water content of the coal is left as it is, raising the temperature of coal by utilizing frictional heat generated during the pulverization, to a temperature above the melting point of said caking agent maintaining the system pressure at a predetermined value by regulating the water content of the pulverized coal, adding said caking agent to the pulverized coal while the coal is kept at said temperature above the melting point of the caking agent, throughly mixing and kneading the caking agent with the pulverized coal and sufficiently spreading it over the pulverized coal and subsequently removing the coal from said tightly closed vessel and briquetting the coal.

2. A process according to claim 1, wherein all the steps other than briquetting are carried out in a single pulverizing-kneading apparatus.

3. A process according to claim 1, wherein said starting coal is a mixed coal.

4. A process according to claim 1, wherein said starting coal is pulverized to a size of 3 mm under 90% or finer.

5. A process according to claim 1, wherein said caking agent is added to said starting coal in an amount of 6 to 10% by weight based on the coal.

6. A process according to claim 1, wherein the pulverization of said starting coal is carried out at a stirring speed of 500 to 1000 r.p.m. and the kneading of the mixture of said starting coal and said caking agent is carried out at a stirring speed of 400 to 800 r.p.m.

7. A process according to claim 1, wherein all steps other than briquetting are completed in a period of at the most to minutes.

8. A process according to claim 1 wherein the water content of the pulverized coal is in 5 to 8 weight % based on the weight of coal.

9. The process according to claim 1 wherein heat is imparted to said closed vessel from external sources.

10. The process according to claim 1 wherein the pressure in said closed vessel is kept at a predetermined value by adding water to said vessel.

11. The process according to claim 1 wherein steam is released from said closed vessel to keep the pressure at said predetermined value.

12. A tightly closed type of kneader for pulverizing a starting coal for coal briquette and kneading the pulverized coal with caking agent which comprises a propeller type inclined lower stirring blade and a U type stirring upper blade near the bottom where both the blades are fixed coaxially or to the same shaft and driven externally, an inlet for the starting coal and an outlet for product both of which can be opened, closed or tightly shut, a coal collecting blade having a sectoral cross section facing the direction of rotation of the coal and fixed inside of the U-type rotating blade, an automatically controlled external heating device and a pressure controlling device which can function also as a discharge valve for excessive steam pressure, and a water-supply pipe.

13. An apparatus for preparing coal briquettes wherein two or three pulverization-kneading kneaders according to claim 12 are provided and operated in parallel.

* * * * *